US006635129B1

(12) United States Patent
Nagahama et al.

(10) Patent No.: US 6,635,129 B1
(45) Date of Patent: Oct. 21, 2003

(54) WIRE ROD STEEL

(75) Inventors: Mutsuhisa Nagahama, Kobe (JP); Masato Kaiso, Kobe (JP); Yoshinori Onoe, Kobe (JP); Shigehiro Mori, Kobe (JP)

(73) Assignee: Kobe Steel Ltd., Kobe (JP)

( * ) Notice: Subject to any disclaimer, the term of this patent is extended or adjusted under 35 U.S.C. 154(b) by 71 days.

(21) Appl. No.: 09/712,911

(22) Filed: Nov. 16, 2000

(30) Foreign Application Priority Data

Nov. 16, 1999 (JP) ..... 11-326014

(51) Int. Cl.[7] ..... C21D 1/84; C22C 38/60
(52) U.S. Cl. ..... 148/579; 148/320; 420/87
(58) Field of Search ..... 420/87; 148/579, 148/320

(56) References Cited

U.S. PATENT DOCUMENTS 3,874,950 A * 4/1975 Grozier et al. ..... 148/602
3,908,431 A * 9/1975 Jones et al. ..... 148/572
4,604,146 A * 8/1986 Aida et al. ..... 148/599
4,719,079 A * 1/1988 Katayama et al. ..... 420/84
4,880,479 A * 11/1989 Birman et al. ..... 148/320

FOREIGN PATENT DOCUMENTS

JP 4-168244 6/1992

* cited by examiner

*Primary Examiner*—Roy King
*Assistant Examiner*—Andrew Wessman
(74) *Attorney, Agent, or Firm*—Oblon, Spivak, McClelland, Maier & Neustadt, P.C.

(57) ABSTRACT

A wire rod steel superior in straightness, after being subjected to cold drawing. This wire rod steel comprises:

| | |
|---|---|
| C: | 0.15 mass % or less (not including 0 mass %), |
| Si: | 0.05 mass % or less (including 0 mass %), |
| Mn: | 0.3–2 mass %, |
| P: | 0.2 mass % or less (including 0 mass %), |
| S: | 0.08–0.5 mass %, |
| Al: | 0.05 mass % or less (including 0 mass %), |
| N: | 0.01 mass % or less (not including 0 mass %), inevitable impurities and Fe as the balance. |

Its ferrite grain size number of the wire rod steel is No. 11 or less according to ISO 643.

7 Claims, 4 Drawing Sheets

WIRE ROD STEEL

BACKGROUND OF THE INVENTION

1. Field of the Invention

The present invention relates to a wire rod steel, that is, a steel product (such as a wire rod or a steel bar) which is used in feeding rollers or paper ejecting rollers (such as various paper feed rollers and paper money feed rollers) which are used in printers or copy machines, out of high-precision and high speed conveying rollers used in industrial machinery; and a process for producing the same. The present invention relates particularly to a steel product superior in straightness after being subjected to cold drawing; and a process suitable for producing such a steel product.

2. Description of Related Art

As development in high-speed printing and multicolored printing in copy machines or printers has been advancing in recent years, a high paper feed precision has been coming to be regarded as important. For this reason, a high precision is demanded for paper feed rollers or paper ejecting rollers in industrial machinery.

In case of producing such a paper feed roller or a paper ejecting roller as above, a steel bar prepared by subjecting a wire-form rolled steel to cold drawing and straightening is cut into a given length to form a round bar as a roller axial part. In such a production process, various techniques have been hitherto suggested in order to improve the paper feed precision of the roller axial part.

As such a technique, for example, JP-A-11-20962 discloses a method of forming spike-form projections on a surface of a round rod made of a metal by plastic working to heighten grip ability between the rod and paper, thereby improving a paper feed precision. JP-A-10-329971 discloses a method of adhering an abrasive grain of alumina, silicon carbide or the like onto the surface of a round rod made of a metal to heighten grip ability between the rod and paper, thereby improving a paper feed precision. JP-A-8-301496 discloses a method of covering the surface of a round rod made of a metal with a rubber to heighten grip ability between the rod and paper, thereby attaining high-precision paper feed ability.

However, in all of the above-mentioned methods suggested until now, only the surface quality of a round rod is adjusted and no characteristic of the round rod which is a raw material is investigated. In other words, a basically important characteristic for improving a paper feed precision is that a round rod used as a roller axial part has straightness, that is, the straightness of the rod after cold drawing is high. Inventions made by investigations from such a standpoint are hardly suggested under the actual situations. As such an invention, only JP-A-4-168244 discloses a method of fixing nitrogen in steel for mechanical structure use, as AlN, with Al to reduce solid solution nitrogen, thereby improving straightness.

SUMMARY OF THE INVENTION

Under the above-mentioned situations, the present invention has been made. An object thereof is to provide a wire rod steel product making it possible to improve straightness (i.e., straightness after cold drawing) of a roller axial part necessary for attaining a high paper feed precision of a paper feed roller or a paper ejecting roller; and a process suitable for producing such a steel product.

The hot-rolled wire rod of the present invention which can attain the above-mentioned object is a wire rod steel superior in straightness, after being subjected to cold drawing, comprising: C: 015% or less (not including 0%), Si: 0.05% or less (not including 0%), Mn: 0.3–2%, P: 0.2% or less (not including 0%), S: 0.08–0.5%, Al: 0.05% or less (not including 0%), N: 0.01% or less (not including 0%), inevitable impurities, and Fe as the balance, the ferrite grain size number of the wire rod steel being No. 11 or less according to ISO 643. Herein, "%" means "mass %". The same rule applies correspondingly to the following in the specification, which does not include claims.

The wire rod steel is directed mainly to various free-cutting steels, and has good machinability on the basis of the above-mentioned composition.

If necessary, the wire rod steel of the present invention may comprise one or more selected from the group consisting of Pb: 0.4 mass % or less (not including 0 mass %), Bi: 0.4 mass % or less (not including 0 mass %), Te: 0.2 mass % or less (not including 0 mass %), Se: 0.2 mass % or less (not including 0 mass %) Sn: 0.4 mass % or less (not including 0 mass %), and In: 0.4 mass % or less (not including 0 mass %)

In case of producing the wire rod steel of the present invention, preferably, hot working of the wire rod steel is ended at 80° C. or higher, and subsequently the wire rod steel is cooled at a cooling rate of 3.0° C./second or less within the temperature range of 800–600° C. ISO 643 completely corresponds to JIS G 0552. Therefore, ferrite grain size number according to ISO 643 is the same number as that according to JIS G 0552.

BRIEF DESCRIPTION OF THE DRAWINGS

Other objects and advantages of the invention will become apparent during the following discussion of the accompanying drawings, wherein.

DETAILED DESCRIPTION OF THE INVENTION

The inventors considered that generation of a bend in a cold finished steel bar obtained by subjecting a wire rod steel to cold drawing and straightening is mainly caused by residual stress remaining in the surface of the cold finished steel bar after the cold drawing. Thus, the inventors investigated steel materials from the standpoint of a reduction in such residual stress. As a result, the inventors have found that in order to reduce the residual stress, it is effective to make the work hardening ratio of the steel materials small and it is preferred for this to set the grain size of ferrite crystal up to an appropriate value and reduce the nitrogen content. Thus, the present invention has been made.

Figure 1:
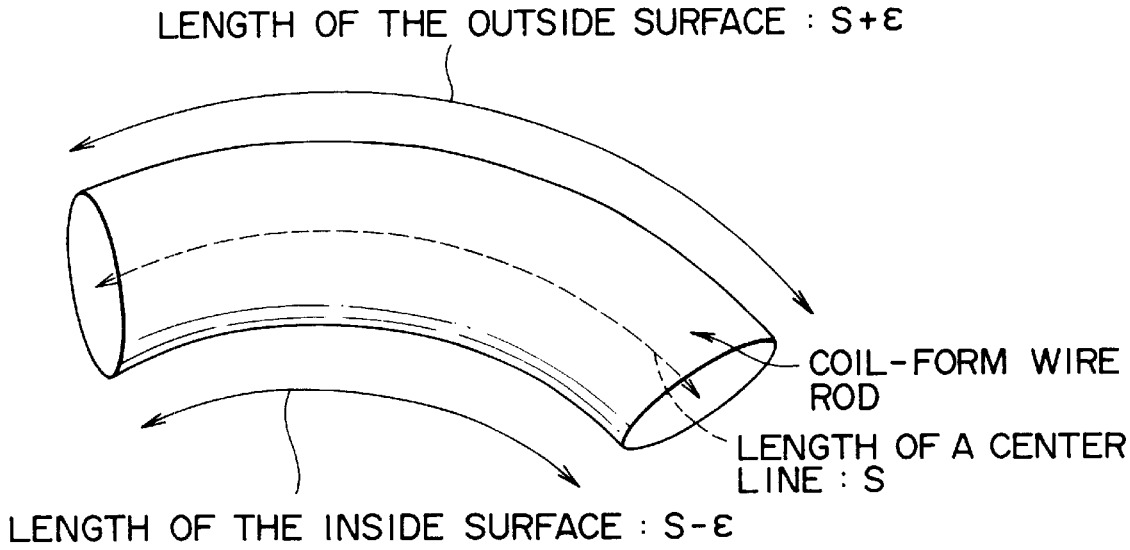
FIG. 1 is a view for explaining the difference between the inside surface of a coil-form rolled steel and the outside surface thereof.
Figure 2:
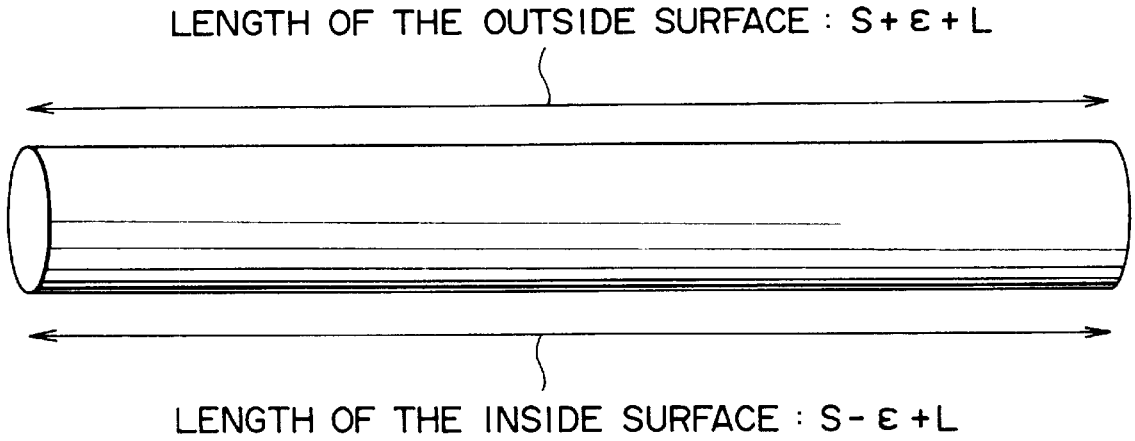
FIG. 2 is a view showing the quantity of a strain remaining in a cold finished steel bar subjected to cold drawing and straightening.

As a steel product used for an axis of a paper feed roller or a paper ejecting roller, a wire rod wound into a coil-form is used. Therefore, the inside surface of the steel product wound into a coil-form is more shrunk as compared with the center of the steel product (i.e., the portion of a central axis). When the length of the center line of a coil-form wire rod is represented by S and the shrunk length of the inside surface thereof is represented by $\epsilon$, as shown in, for example, FIG. 1 (that is, when the length of the inside surface is represented by $S-\epsilon$) the outside surface thereof is extended by the length E (that is, the length of the outside surface is $S+\epsilon$). Even if the steel product in this condition is extended and subjected to cold drawing and plastic working so that a steel bar extended by the length L is obtained, the difference represented by the following equation (1) [i.e., $2\epsilon$] in the extension is originally present between the inside surface and the outside surface (see FIG. 2).

$$(S+\epsilon+L)-(S-\epsilon+L)=2\epsilon \quad (1)$$

Therefore, residual stress caused by the above-mentioned extension-difference ($2\epsilon$) is generated in the surface of the drawn steel bar subjected to plastic deformation by cold drawing and subsequent elastic recovery. For this reason, a bend is generated in the drawn steel bar. Even if such a drawn steel bar is put on a straightening machine so as to be turned into a cold finished steel bar wherein the quantity of the bend is reduced, this operation does not become a fundamental solving means for improving the straightness of the steel product.

In light of such a matter, in order to solve the above-mentioned problems, it is important to make the slant $d\epsilon/d\sigma$ of the stress-strain curve in the plastic deformation area small so as to make the stress caused by the $2\epsilon$ as small as possible. In other words, it is necessary to make the work hardening ratio of the steel bar as small as possible. The inventors have found that first it is important for this to make the grain size of ferrite crystal large (i.e., make the ferrite grain size number small) and second it is important to remove nitrogen, which is a component which causes an increase in the work hardening ratio, as much as possible from the steel material.

From the above-mentioned standpoint, the steel product of the present invention is a steel product wherein the ferrite grain size number is No. 11.0 or less as the fineness number according to ISO 643 and the N content is 0.01% or less. Reasons for defining theses ranges are as follows.

Ferrite grain size number: No. 11.0 or less as the fineness number according to ISO 643.

The ferrite grain size number (the grain size of ferrite) is a parameter effective for lowering the work hardening ratio. If the ferrite grain size number is over No. 11, the work hardening ratio becomes too high so that the bend quantity of the cold finished steel bar becomes rough after cold drawing and straightening. The upper limit of the ferrite grain size number is preferably No. 9.8.

Figure 3:
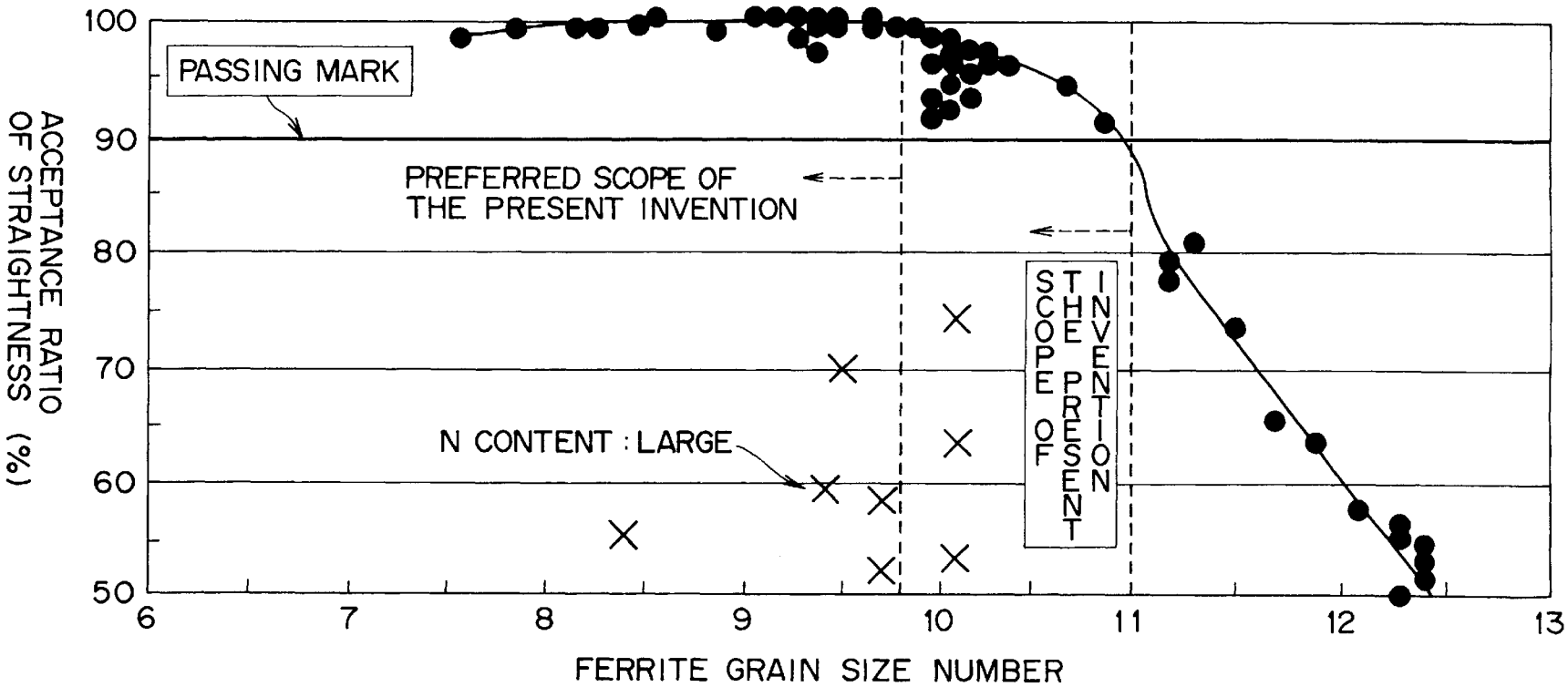
FIG. 3 is a graph showing a relationship between the ferrite grain size number and the acceptance ratio of straightness.

FIG. 3 is a graph showing a relationship between the ferrite grain size number and the acceptance ratio of the straightness. The acceptance ratio of the straightness is a ratio that the ratio of steel products which have a bend quantity of 50 $\mu$m or less as acceptable steel bars is represented by using the unit "percentage". As is evident from FIG. 3, when the ferrite grain size number is No. 11 or less, an acceptance ratio of 90% is attached. Moreover, if this number is No. 9.8 or less, an acceptance ratio of about 100% can be obtained.

N: 0.01% or Less

Figure 5:
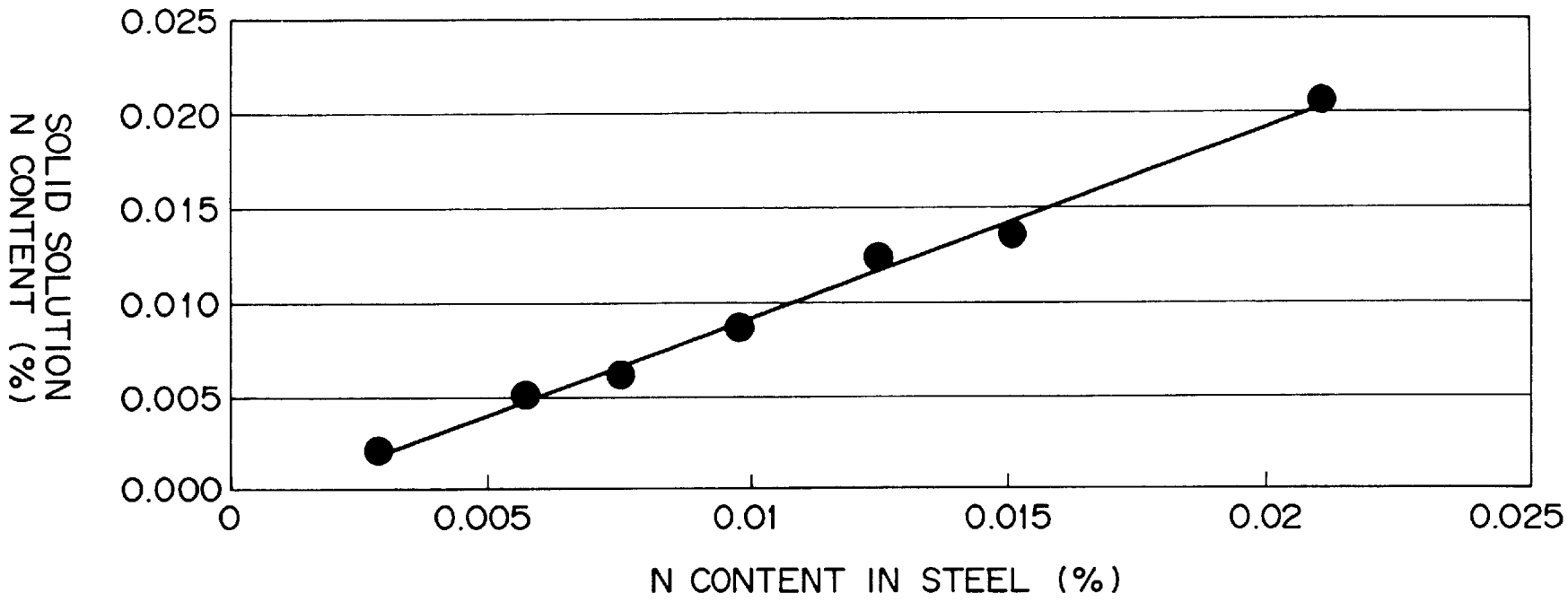
FIG. 5 is a graph showing a relationship between the N content in steel and the solid solution N content in steel.

The inventors have examined the relationship between the bend quantity of cold finished steel bars subjected to cold drawing and straightening and the solid solution N content therein so as to find that the bend quantity of the cold finished steel bars becomes larger as the solid solution N content therein is larger. The presence of a large amount of solid solution N in the steels increases work hardening of the steels. Therefore, it can be considered that if wire rods wound into a coil-form are subjected to cold drawing, largely different residual stresses are generated in respective sites in the steel surface along the axial direction, so that these stresses cause a large bend even if the wire rods are subjected to straightening after cold drawing. In order that such a bend of the cold finished steel bars does not remain, it is necessary to reduce the solid solution N content in the steels as much as possible. The solid solution N content is measured as follows. First, the N content ⓪ by percentage in steel is measured by chemical analysis. The amount by percentage of AlN is analyzed by a residue-extraction method to obtain the amount ② by percentage of N bonded to Al. The difference therebetween ①-②) is the solid solution N content. The relationship between the solid solution N content and the N content in the steel was examined by experiments. As a result, it has been found that they correspond linearly to each other, as shown in FIG. 5. Accordingly, it can be understood that the condition for causing no bend of the cold finished steel bar to remain may be defined by the N content in the steel instead of the solid solution N content. In order to analyze the amount of AlN by the residue-extraction method, the steel is first dissolved in a 10% acetylacetone type electrolyte. The resultant solution is subjected to absorption filtration with a filter having a mesh size of 0.2 $\mu$m to extract residue. This residue is used to determine the quantity of AlN by neutralization titration. From such standpoints, the N content in the steel product of the present invention is set up to 0.01% or less The N content is preferably is set up to 0.008% or less. Within this range, advantages of the present invention can be attained at a maximum level.

Figure 4:
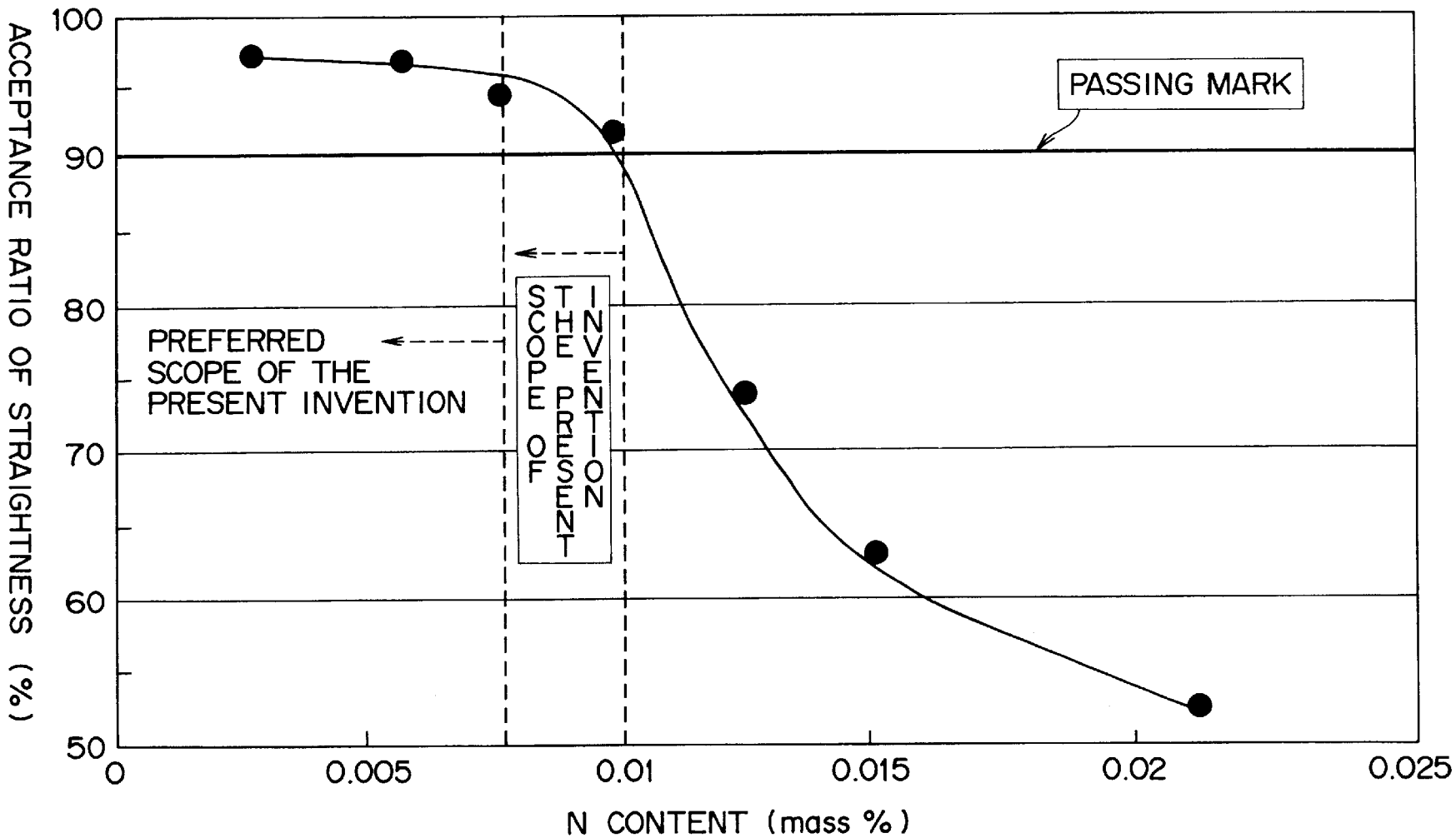
FIG. 4 is a graph showing a relationship between the N content in steel and the acceptance ratio of straightness.

FIG. 4 is a graph showing a relationship between the N content in steels and the acceptance ratio of the straightness thereof, which is evaluated as described above. As is evident from FIG. 4, if the N content is 0.01% or less, an acceptance ratio of 90% is attained, and further if the N content is 0.008% or less, an acceptance ratio of 100% can be obtained.

The steel product of the present invention is mainly directed to various kinds of free-cutting steels. Preferred ranges of the amounts of C, Si, Mn, P, S and Al, which are basic elements of such steels, and reasons for defining theses ranges are as follows.

C: 0.15% or Less (Not Including 0%)

C is an element effective for imparting a given strength to the steel product to improve the surface characteristic (the surface roughness) of this steep product after being cut. However, if C is contained in an excessive amount, the steel product becomes too hard so that the tool life is shortened. Thus, the C content is preferably 0.15% or less. The lower limit thereof is more preferably 0.05%. The upper limit thereof is 0.10%.

Si: 0.05% or Less (Including 0%)

The amount of Si is preferably as small as possible. If the Si content becomes excessive, the steel product undergoes work hardening because of the solid solution strengthening of ferrite so that an adverse effect is produced on the straightness. If the Si content is too large, the oxygen concentration in the steel at the time of steel making is lowered so that the oxygen concentration in MnS is also lowered. The form of MnS has an adverse effect on machinability of the steel. The surface roughness of the steel becomes rough. From this standpoint, the Si content is limited preferably to 0.05% or less, more preferably to 0.03% or less, and most preferably to 0.01% or less.

Mn: 0.3–2%

Mn is an element effective for imparting a given strength to the steel. If the Mn content is below 0.3%, FeS is generated so that a liquid phase is produced upon rolling. Thus, cracks are easily generated. From this standpoint, the Mn content is preferably set up to 0.3% or more. However, if Mn is added over such an amount that MnS which contributes to chip breakability is formed, work hardening is caused because of ferrite solid solution so that an adverse effect is produced on the straightness. Therefore, the Mn is preferably set up to 2% or less, correspondingly to the amount of S. The lower limit of the Mn content is more preferably is 0.5%, and the upper limit thereof is more preferably 1.5%.

P: 0.2% or Less (Including 0%)

P causes a rise in the work hardening ratio of the steel. Thus, if P is contained therein, residual stress is easily generated in the surface of the cold finished steel bar subjected to cold drawing and straightening. P also causes a rise in the hardness of the steel product so that the tool life is shortened. Thus, the amount of P is preferably as small as possible. If the P content is 0.2% or less, an adverse effect is not substantially produced on the straightness. Therefore, the P content is preferably set up to 0.2% or less. The upper limit of the P content is more preferably 0.1%. Within this range, P hardly has an adverse effect on the tool life.

S 0.08–0.5%

S is added to the steel product in order to improve machinability thereof. However, if the S content is below 0.08%, the surface roughness becomes rough. The S content is preferably 0.15% or more. If the S content however becomes excessive to be over 0.5%, surface imperfections increase. The upper limit of the S content is more preferably 0.4%.

Al: 0.05% or Less (Including 0%)

Al may be added to the steel product in order to fix N as AlN. The AlN however exhibits pinch effect to prevent the shift of dislocation. Therefore, the AlN may have an adverse effect on the quantity of a bend even if the steel product is subjected to cold drawing and straightening, through the extent of the adverse effect is smaller than that of the solid solution N. From such a standpoint, the Al content is preferably 0.05% or less. If the Al content is over 0.05% so as to be excessive, work hardening is enlarged by the precipitation of a large amount of AlN. In addition thereto, the oxygen concentration in the steel, when steel making, is lowered so that the oxygen concentration in MnS is also lowered. Therefore, the form of MnS has an adverse effect on the machinability of the steel so that the surface roughness becomes rough. The upper limit of the Al content is preferably 0.01%, and is more preferably 0.005%.

Basic chemical components in the case that the steel product of the present invention is applied to free-cutting steel are as described above. The balance consists substantially of Fe. If necessary, it is effective to add one or more selected from the group consisting of Pb, Bi, Te, Se, Sn and In. These elements contribute to an improvement in machinability. Ranges of amounts of the respective components, if they are added, and reasons for defining the ranges are as follows.

Pb: 0.4% or Less (Not Including 0%)

Pb is added to improve the machinability of the steel product. If the Pb content becomes excessive to be over 0.4%, the hot workability deteriorates so that surface imperfections of the steel product increase. The upper limit of the Pb content is preferably 0.3%.

Bi: 0.4% or Less (Not Including 0%)

Bi is an element effective for improving the machinability. If the Bi content becomes excessive to be over 0.4%, the hot workability deteriorates so that surface imperfections of the steel product increase. The upper limit of the Bi content is preferably 0.3%.

Te: 0.2% or Less (not Including 0%)

Te is combined with S to produce a compound with Mn, that is, Mn(Te, S), whereby the machinability is improved. If the Te content is over 0.2%, the hot workability deteriorates so that surface imperfections of the steel product are generated. The upper limit of the Te content is preferably 0.15%.

Se: 0.3% or Less (Not Including 0%)

Se is combined with S to produce a compound with Mn, that is, Mn(Se, S), whereby the machinability is improved. If the Se content is over 0.3%, the hardness at high temperatures rises so that the machinability deteriorates. The upper limit of the Se content is preferably 0.2%.

Sn: 0.4% or less (not including 0%)

Sn is an element effective for improving the machinability. If the Sn content becomes excessive to be over 0.4%, the hot workability deteriorates so that surface imperfections of the steel product increase. The upper limit of the Sn content is preferably 0.3%.

In: 0.4% or Less (Not Including 0%)

In is an element effective for improving the machinability. If the In content becomes excessive to be over 0.4%, the hot workability deteriorates so that surface imperfections of the steel product increase. The upper limit of the In content is preferably 0.3%.

It is also effective to add, to the steel product of the present invention, Cr, Ni, V, Ti, Nb or the like, as well as the above-mentioned components. These elements contribute to an improvement in the strength of the steel. In the case that these elements are added thereto, each of the amounts of the elements is preferably set up to 1% or less from the standpoint of the straightness and the tool life.

The steel product of the present invention may contain one or more trace components, which do not hinder its property, besides the above-mentioned respective components. Free-cutting steels containing the trace component(s) are also included in the technical scope of the present invention. Examples of the trace components include acceptable components such as B and O; and impurities such as Cu, Ca, Mg, As and rare earth elements, in particular, inevitable impurities.

When the steel product comprising the components defined in the present invention is produced, it is preferred to conduct hot working at 800° C. or higher and subsequently conduct cooling at a cooling rate of 3.0° C./second or less within the range of 800–600° C. Reasons for defining the respective requirements in this production process are as follows.

In the case that hot working ending temperature (ending temperature of hot rolling finishing) is below 800° C., desired ferrite grain size cannot be obtained even if the steel is cooled. In the process of the present invention, therefore, it is necessary to set the hot working ending temperature up to 800° C. or higher. In order to make the ferrite grain size number into No. 9.8 or less, it is preferred to set the hot working ending temperature up to 850° C. or higher.

In order to make the ferrite grain size large in the present invention, it is necessary to cool the steel at a cooling rate of 3.0° C./second or less within the range of 800–600° C. If the cooling rate at this time is over 3.0° C./second, the ferrite grain size do not get large and the bend quantity of the cold finished steel bar after being subjected to cooling drawing and straightening is kept large. For this reason, it is necessary to adjust the cooling rate to 3.0° C./second or less. In order to make the ferrite grain size number into No. 9.8 or less, it is preferred to set the cooling rate to 1.9° C./second or less. The temperature range within which the steel is cooled at a cooling rate of 3.0° C./second or less is from 800 to 600° C. This is because the cooling rate at temperatures near the $\gamma/\alpha$ transformation temperature present in this temperature range has a great influence on the phenomenon that the ferrite grains become coarse.

The present invention will be more specifically described by way of examples hereinafter. The present invention is not limited to the following examples. Modifications and design changes in light of the subject matters described above and later are included in the technical scope of the present invention.

EXAMPLES

Respective free-cutting steels having the compositions of chemical components shown in Tables 1 and 2 were prepared, and these steels were subjected to rolling in the manner that the rolling would end at hot rolling finishing temperatures shown in Tables 3 and 4. The steels were cooled at various cooling rates within the temperature range of 800–600° C. to produce sample steels of 9.5 mm in diameter.

TABLE 1

| Symbol of samples | Composition of chemical component | | | | | | | |
|---|---|---|---|---|---|---|---|---|
| | C | Si | Mn | P | S | Al | N | others |
| A1 | 0.07 | 0.001 | 1.15 | 0.08 | 0.30 | 0.001 | 0.0028 | — |
| A2 | 0.07 | 0.001 | 1.23 | 0.08 | 0.29 | 0.001 | 0.0057 | — |
| A3 | 0.08 | 0.001 | 1.18 | 0.08 | 0.30 | 0.001 | 0.0075 | — |
| A4 | 0.08 | 0.001 | 1.17 | 0.08 | 0.31 | 0.001 | 0.0098 | — |
| A5 | 0.07 | 0.001 | 1.17 | 0.08 | 0.30 | 0.001 | 0.0125 | — |
| A6 | 0.08 | 0.001 | 1.22 | 0.08 | 0.30 | 0.001 | 0.0151 | — |
| A7 | 0.07 | 0.001 | 1.24 | 0.07 | 0.33 | 0.001 | 0.0211 | — |
| B1 | 0.09 | 0.001 | 1.19 | 0.08 | 0.29 | 0.001 | 0.0049 | — |
| B2 | 0.07 | 0.001 | 1.16 | 0.08 | 0.31 | 0.001 | 0.0053 | — |
| B3 | 0.08 | 0.001 | 1.23 | 0.08 | 0.31 | 0.001 | 0.0051 | — |
| B4 | 0.07 | 0.001 | 1.20 | 0.08 | 0.29 | 0.001 | 0.0055 | — |
| B5 | 0.07 | 0.001 | 1.22 | 0.08 | 0.30 | 0.001 | 0.0057 | — |
| B6 | 0.07 | 0.001 | 1.20 | 0.08 | 0.30 | 0.001 | 0.0052 | — |
| B7 | 0.07 | 0.001 | 1.22 | 0.08 | 0.31 | 0.001 | 0.0051 | — |
| B8 | 0.07 | 0.001 | 1.21 | 0.08 | 0.31 | 0.001 | 0.0049 | — |
| B9 | 0.07 | 0.001 | 1.23 | 0.08 | 0.32 | 0.001 | 0.0053 | — |
| B10 | 0.08 | 0.001 | 1.19 | 0.08 | 0.30 | 0.001 | 0.0055 | — |
| B11 | 0.07 | 0.001 | 1.20 | 0.08 | 0.33 | 0.001 | 0.0054 | — |
| B12 | 0.07 | 0.001 | 1.21 | 0.08 | 0.32 | 0.001 | 0.0048 | — |
| B13 | 0.07 | 0.001 | 1.21 | 0.08 | 0.31 | 0.001 | 0.0050 | — |
| B14 | 0.07 | 0.001 | 1.22 | 0.08 | 0.31 | 0.001 | 0.0052 | — |
| B15 | 0.07 | 0.001 | 1.23 | 0.08 | 0.32 | 0.001 | 0.0053 | — |
| B16 | 0.08 | 0.001 | 1.19 | 0.08 | 0.31 | 0.001 | 0.0054 | — |
| B17 | 0.07 | 0.001 | 1.21 | 0.08 | 0.32 | 0.001 | 0.0052 | — |
| B18 | 0.08 | 0.001 | 1.21 | 0.08 | 0.32 | 0.001 | 0.0052 | — |
| B19 | 0.08 | 0.001 | 1.20 | 0.08 | 0.29 | 0.001 | 0.0048 | — |
| B20 | 0.07 | 0.001 | 1.19 | 0.08 | 0.30 | 0.001 | 0.0049 | — |
| B21 | 0.07 | 0.001 | 1.19 | 0.08 | 0.29 | 0.001 | 0.0053 | — |
| C1 | 0.07 | 0.012 | 1.22 | 0.08 | 0.31 | 0.001 | 0.0052 | — |
| C2 | 0.07 | 0.031 | 1.19 | 0.08 | 0.29 | 0.001 | 0.0049 | — |
| C3 | 0.08 | 0.059 | 1.19 | 0.08 | 0.33 | 0.001 | 0.0050 | — |
| C4 | 0.07 | 0.070 | 1.18 | 0.08 | 0.32 | 0.001 | 0.0048 | — |
| D1 | 0.07 | 0.001 | 0.18 | 0.08 | 0.08 | 0.001 | 0.0051 | — |
| D2 | 0.07 | 0.001 | 0.33 | 0.08 | 0.08 | 0.001 | 0.0053 | — |
| D3 | 0.08 | 0.001 | 1.18 | 0.08 | 0.28 | 0.001 | 0.0045 | — |
| D4 | 0.07 | 0.001 | 1.97 | 0.08 | 0.47 | 0.001 | 0.0052 | — |
| D5 | 0.07 | 0.001 | 2.33 | 0.08 | 0.56 | 0.001 | 0.0050 | — |

TABLE 2

| Symbol of samples | Composition of chemical component | | | | | | | |
|---|---|---|---|---|---|---|---|---|
| | C | Si | Mn | P | S | Al | N | Others |
| E1 | 0.08 | 0.001 | 1.16 | 0.01 | 0.30 | 0.001 | 0.0049 | — |
| E2 | 0.08 | 0.001 | 1.18 | 0.13 | 0.31 | 0.001 | 0.0048 | — |
| E3 | 0.07 | 0.001 | 1.22 | 0.25 | 0.31 | 0.001 | 0.0052 | — |
| F1 | 0.07 | 0.001 | 1.23 | 0.08 | 0.33 | 0.032 | 0.0052 | — |
| F2 | 0.07 | 0.001 | 1.22 | 0.08 | 0.33 | 0.049 | 0.0051 | — |
| F3 | 0.07 | 0.001 | 1.23 | 0.08 | 0.31 | 0.072 | 0.0054 | — |
| G1 | 0.07 | 0.001 | 1.19 | 0.08 | 0.30 | 0.001 | 0.0049 | Pb: 0.05 |
| G2 | 0.08 | 0.001 | 1.17 | 0.08 | 0.32 | 0.001 | 0.0052 | Pb: 0.12 |
| G3 | 0.08 | 0.001 | 1.16 | 0.08 | 0.31 | 0.001 | 0.0054 | Pb: 0.18 |
| G4 | 0.07 | 0.001 | 1.13 | 0.08 | 0.30 | 0.001 | 0.0053 | Pb: 0.26 |
| G5 | 0.07 | 0.001 | 1.12 | 0.08 | 0.32 | 0.001 | 0.0050 | Pb: 0.35 |
| G6 | 0.07 | 0.001 | 1.10 | 0.08 | 0.31 | 0.001 | 0.0129 | Pb: 0.26 |
| G7 | 0.07 | 0.001 | 1.11 | 0.08 | 0.33 | 0.001 | 0.0054 | Pb: 0.25 |
| H1 | 0.07 | 0.001 | 1.22 | 0.08 | 0.31 | 0.001 | 0.0051 | Bi: 0.005 |
| H2 | 0.08 | 0.001 | 1.21 | 0.08 | 0.31 | 0.001 | 0.0052 | Bi: 0.04 |
| H3 | 0.07 | 0.001 | 1.19 | 0.08 | 0.32 | 0.001 | 0.0049 | Bi: 0.11 |
| H4 | 0.07 | 0.001 | 1.23 | 0.08 | 0.31 | 0.001 | 0.0051 | Bi: 0.17 |
| H5 | 0.08 | 0.001 | 1.22 | 0.08 | 0.33 | 0.001 | 0.0159 | Bi: 0.06 |
| H6 | 0.07 | 0.001 | 1.24 | 0.08 | 0.32 | 0.001 | 0.0047 | Bi: 0.07 |
| J1 | 0.08 | 0.001 | 1.12 | 0.08 | 0.33 | 0.001 | 0.0048 | Pb: 0.18, Bi: 0.03, Sn: 0.01 |

TABLE 2-continued

| Symbol of samples | Composition of chemical component | | | | | | | |
|---|---|---|---|---|---|---|---|---|
| | C | Si | Mn | P | S | Al | N | Others |
| J2 | 0.07 | 0.001 | 1.13 | 0.08 | 0.31 | 0.001 | 0.0177 | Pb: 0.17, Bi: 0.03, Sn: 0.02 |
| J3 | 0.07 | 0.001 | 1.13 | 0.08 | 0.30 | 0.001 | 0.0049 | Pb: 0.18, Bi: 0.04, Sn: 0.01 |
| J4 | 0.07 | 0.001 | 1.12 | 0.08 | 0.28 | 0.001 | 0.0052 | In: 0.25 |
| J5 | 0.07 | 0.001 | 1.15 | 0.08 | 0.29 | 0.001 | 0.0047 | In: 0.12 |
| J6 | 0.08 | 0.001 | 1.13 | 0.08 | 0.27 | 0.001 | 0.0049 | In: 0.02 |
| J7 | 0.08 | 0.001 | 1.13 | 0.08 | 0.27 | 0.001 | 0.0182 | In: 0.05 |
| J8 | 0.07 | 0.001 | 1.12 | 0.08 | 0.26 | 0.001 | 0.0047 | In: 0.04 |
| J9 | 0.08 | 0.001 | 1.11 | 0.08 | 0.29 | 0.001 | 0.0048 | Te: 0.10, Se: 0.15 |
| J10 | 0.08 | 0.001 | 1.12 | 0.08 | 0.28 | 0.001 | 0.0051 | Te: 0.12, Se: 0.13 |
| J11 | 0.08 | 0.001 | 1.13 | 0.08 | 0.08 | 0.001 | 0.0050 | Te: 0.02, Se: 0.04 |
| J12 | 0.08 | 0.001 | 1.14 | 0.08 | 0.28 | 0.001 | 0.0189 | Te: 0.03, Se: 0.02 |
| J13 | 0.08 | 0.001 | 1.13 | 0.08 | 0.29 | 0.001 | 0.0052 | Te: 0.03, Se: 0.02 |
| J14 | 0.07 | 0.001 | 1.12 | 0.08 | 0.28 | 0.001 | 0.0042 | Sn: 0.35 |
| J15 | 0.08 | 0.001 | 1.14 | 0.08 | 0.27 | 0.001 | 0.0048 | Sn: 0.21 |
| J16 | 0.07 | 0.001 | 1.13 | 0.08 | 0.28 | 0.001 | 0.0050 | Sn: 0.10 |
| J17 | 0.07 | 0.001 | 1.14 | 0.08 | 0.29 | 0.001 | 0.0044 | Sn: 0.02 |
| J18 | 0.08 | 0.001 | 1.13 | 0.08 | 0.33 | 0.001 | 0.0045 | Pb: 0.18, Bi: 0.03 |
| K1 | 0.08 | 0.001 | 1.25 | 0.08 | 0.32 | 0.001 | 0.0054 | Bi: 0.03, Cr: 0.2 |
| K2 | 0.07 | 0.001 | 1.24 | 0.08 | 0.31 | 0.001 | 0.0056 | Bi: 0.12, Ni: 0.1 |
| K3 | 0.07 | 0.001 | 1.25 | 0.08 | 0.32 | 0.001 | 0.0073 | Bi: 0.07, Ti: 0.02 |
| K4 | 0.07 | 0.001 | 1.23 | 0.08 | 0.32 | 0.001 | 0.0082 | Bi: 0.09, Nb: 0.02 |
| K5 | 0.08 | 0.001 | 1.22 | 0.08 | 0.31 | 0.001 | 0.0049 | Bi: 0.01. V: 0.04 |

The resultant sample steels were examined about their ferrite grain size number and their straightness. The ferrite grain size number was obtained as follows. About cross sections of 10 points which were arbitrarily selected from each of the sample steels, the fineness numbers of their sites having a depth of ¼ of the diameter in the direction from the surface to the center were measured according to ISO 643, and the average of the resultant values were obtained.

The straightness of the sample steels was evaluated on the basis of the above-mentioned acceptance ratio, which was calculated by the following method. First, cold finished steel bar 8.0 mm in diameter was produced from each of the sample steels 9.5 mm in diameter. Straightening at this time was performed, using a two-roll straightening machine after wire drawing. Next, the cold finished steel bar was cut to have a length of 500 mm. Thereafter, the cut steel bar was put on a V block having a span of 400 mm, and was then rotated in the direction along which this bar could be rolled. While the steel bar was rotated as above, the displacement of the cold finished steel bar was measured by means of a displacement-measuring laser device arranged at the center of the span. If the cold finished steel bar is bend at such a time, displacement is generated at the above-mentioned center while this bar rotates. Therefore, the values detected with the displacement-measuring laser device does not become constant. Thus, the minimum value of the detected values during several rotations of the cold finished steel bar is subtracted from the maximum value thereof. The resultant value is defined as the displacement of the cold finished steel bar. In the present invention, this displacement is defined as bend quantity. One hundred samples arbitrarily selected from each of the cold finished steel bars were measured. The samples having a bend quantity of 50 $\mu$m or less were evaluated as acceptance products. The percentage of the acceptance products was calculated. The surface condition of the resultant steel products and the machinability of the cold finished steel bars were evaluated as follows. The results thereof were collectively shown in Tables 3 and 4.

Surface Condition of the Steel Products

The samples having no surface imperfections were shown as ○, and the samples having one or more imperfections were shown as $^{x}$.

Machinability of the Cold Finished Steel Bars

The bars were cut under the following cutting test (turning) conditions, and then the roughness of the resultant finished surfaces were evaluated (good: ○, and bad: $^{x}$).

Tool: cemented carbide (WC-Co),

Cutting speed: 150 m/min.

Feed: 0.05 mm/rev.

Notch: 2.0 mm

TABLE 3

| Symbol of samples | Ending temperature of hot rolling finish (° C.) | Cooling rate (° C/second) | Ferrite grain size number (No.) | Acceptance ratio of straightness | Surface condition of the rolled steel | Machinability | Notes |
|---|---|---|---|---|---|---|---|
| A1 | 853 | 2.8 | 10.2 | 97 | ○ | ○ | Example |
| A2 | 848 | 2.6 | 10.1 | 97 | ○ | ○ | Example |
| A3 | 847 | 2.7 | 10.2 | 95 | ○ | ○ | Example |
| A4 | 854 | 2.9 | 10.1 | 92 | ○ | ○ | Example |
| A5 | 850 | 2.7 | 10.1 | 74 | ○ | ○ | Comparative Example |
| A6 | 851 | 2.7 | 10.1 | 63 | ○ | ○ | Comparative Example |
| A7 | 848 | 2.6 | 10.1 | 53 | ○ | ○ | Comparative Example |
| B1 | 718 | 2.0 | 12.4 | 53 | ○ | ○ | Comparative Example |
| B2 | 775 | 2.6 | 11.5 | 73 | ○ | ○ | Comparative Example |

TABLE 3-continued

| Symbol of samples | Ending temperature of hot rolling finish (° C.) | Cooling rate (° C/second) | Ferrite grain size number (No.) | Acceptance ratio of straightness | Surface condition of the rolled steel | Machinability | Notes |
|---|---|---|---|---|---|---|---|
| B3 | 851 | 1.4 | 9.4 | 99 | ○ | ○ | Example |
| B4 | 861 | 1.6 | 9.2 | 100 | ○ | ○ | Example |
| B5 | 803 | 0.5 | 8.3 | 99 | ○ | ○ | Example |
| B6 | 923 | 1.8 | 7.6 | 98 | ○ | ○ | Example |
| B7 | 827 | 1.5 | 10.3 | 97 | ○ | ○ | Example |
| B8 | 804 | 1.7 | 10.7 | 94 | ○ | ○ | Example |
| B9 | 738 | 2.2 | 12.1 | 57 | ○ | ○ | Comparative Example |
| B10 | 709 | 1.5 | 12.3 | 55 | ○ | ○ | Comparative Example |
| B11 | 802 | 3.8 | 11.7 | 65 | ○ | ○ | Comparative Example |
| B12 | 862 | 1.9 | 9.7 | 100 | ○ | ○ | Example |
| B13 | 883 | 1.8 | 8.9 | 99 | ○ | ○ | Example |
| B14 | 907 | 2.9 | 8.6 | 100 | ○ | ○ | Example |
| B15 | 938 | 2.9 | 7.9 | 99 | ○ | ○ | Example |
| B16 | 743 | 1.2 | 11.2 | 79 | ○ | ○ | Comparative Example |
| B17 | 809 | 4.0 | 11.9 | 63 | ○ | ○ | Comparative Example |
| B18 | 855 | 1.0 | 8.2 | 99 | ○ | ○ | Example |
| B19 | 801 | 3.1 | 11.2 | 77 | ○ | ○ | Comparative Example |
| B20 | 805 | 3.5 | 11.3 | 81 | ○ | ○ | Comparative Example |
| B21 | 815 | 3.0 | 10.9 | 91 | ○ | ○ | Example |
| C1 | 855 | 2.6 | 10.0 | 96 | ○ | ○ | Example |
| C2 | 843 | 2.2 | 10.1 | 97 | ○ | ○ | Example |
| C3 | 849 | 2.3 | 10.1 | 94 | ○ | ○ | Example |
| C4 | 820 | 1.2 | 10.0 | 91 | ○ | ○ | Example |
| D1 | 805 | 1.1 | 9.9 | 99 | ○ | ○ | Example |
| D2 | 863 | 2.4 | 9.8 | 99 | ○ | ○ | Example |
| D3 | 825 | 1.4 | 10.1 | 96 | ○ | ○ | Example |
| D4 | 830 | 1.6 | 10.1 | 94 | ○ | ○ | Example |
| D5 | 815 | 1.3 | 10.2 | 93 | ○ | ○ | Example |

TABLE 4

| Symbol of samples | Ending temperature of hot rolling finish (° C.) | Cooling rate (° C/second) | Ferrite grain size number (No.) | Acceptance ratio of straightness | Surface condition of the rolled steel | Machinability | Notes |
|---|---|---|---|---|---|---|---|
| E1 | 823 | 1.4 | 10.1 | 98 | ○ | ○ | Example |
| E2 | 818 | 1.3 | 10.2 | 95 | ○ | ○ | Example |
| E3 | 821 | 1.2 | 10.0 | 92 | ○ | x | Comparative Example |
| F1 | 833 | 1.6 | 10.1 | 96 | ○ | ○ | Example |
| F2 | 838 | 2.0 | 10.0 | 96 | ○ | x | Comparative Example |
| F3 | 832 | 2.2 | 10.2 | 93 | ○ | ○ | Example |
| G1 | 866 | 1.5 | 9.2 | 100 | ○ | ○ | Example |
| G2 | 867 | 1.7 | 9.3 | 100 | ○ | ○ | Example |
| G3 | 866 | 1.8 | 9.4 | 100 | ○ | ○ | Example |
| G4 | 874 | 1.9 | 9.3 | 98 | ○ | ○ | Example |
| G5 | 847 | 1.2 | 9.4 | 97 | ○ | ○ | Example |
| G6 | 850 | 1.4 | 9.5 | 70 | ○ | ○ | Comparative Example |
| G7 | 738 | 2.8 | 12.3 | 56 | ○ | ○ | Comparative Example |
| H1 | 864 | 1.4 | 9.2 | 100 | ○ | ○ | Example |
| H2 | 870 | 1.6 | 9.1 | 100 | ○ | ○ | Example |
| H3 | 851 | 1.5 | 9.5 | 99 | ○ | ○ | Example |
| H4 | 855 | 1.5 | 9.4 | 100 | ○ | ○ | Example |
| H5 | 858 | 1.7 | 9.4 | 59 | ○ | ○ | Comparative Example |
| H6 | 720 | 2.4 | 12.4 | 51 | ○ | ○ | Comparative Example |
| J1 | 854 | 1.0 | 8.5 | 99 | ○ | ○ | Example |
| J2 | 876 | 1.2 | 8.4 | 55 | ○ | ○ | Comparative Example |
| J3 | 728 | 2.5 | 12.4 | 52 | ○ | ○ | Comparative Example |
| J4 | 847 | 2.2 | 10.0 | 98 | ○ | ○ | Example |
| J5 | 844 | 2.6 | 10.2 | 97 | ○ | ○ | Example |
| J6 | 839 | 1.5 | 9.7 | 99 | ○ | ○ | Example |
| J7 | 830 | 1.3 | 9.7 | 52 | ○ | ○ | Comparative Example |
| J8 | 742 | 2.6 | 12.3 | 50 | ○ | ○ | Comparative Example |
| J9 | 849 | 1.5 | 9.5 | 100 | ○ | ○ | Example |
| J10 | 847 | 2.2 | 10.1 | 97 | ○ | ○ | Example |
| J11 | 855 | 1.9 | 9.8 | 99 | ○ | ○ | Example |
| J12 | 863 | 2.2 | 9.7 | 58 | ○ | ○ | Comparative Example |
| J13 | 717 | 1.5 | 12.4 | 54 | ○ | ○ | Comparative Example |
| J14 | 830 | 0.9 | 8.6 | 100 | ○ | ○ | Example |

TABLE 4-continued

| Symbol of samples | Ending temperature of hot rolling finish (° C.) | Cooling rate (° C/second) | Ferrite grain size number (No.) | Acceptance ratio of straightness | Surface condition of the rolled steel | Machinability | Notes |
|---|---|---|---|---|---|---|---|
| J15 | 839 | 1.8 | 10.0 | 93 | ○ | ○ | Example |
| J16 | 821 | 1.4 | 10.3 | 96 | ○ | ○ | Example |
| J17 | 854 | 1.9 | 9.7 | 99 | ○ | ○ | Example |
| J18 | 865 | 1.7 | 9.4 | 100 | ○ | ○ | Example |
| K1 | 838 | 2.1 | 10.2 | 97 | ○ | ○ | Example |
| K2 | 822 | 1.8 | 10.4 | 96 | ○ | ○ | Example |
| K3 | 855 | 1.4 | 9.4 | 100 | ○ | ○ | Example |
| K4 | 853 | 1.6 | 9.5 | 100 | ○ | ○ | Example |
| K5 | 854 | 1.6 | 9.5 | 100 | ○ | ○ | Example |

From these results, the following can be understood. Samples A1–A6 were samples wherein the N content was changed. In the samples A1–A4, the N content was within the range defined in the present invention. Their acceptance ratio of the straightness was 92% or more. On the other hand, in the sample A5, the N content was over the range defined in the present invention (N: 0.0125%), and the bend quantity thereof was large by work hardening. Thus, its acceptance ratio of the straightness was 74%. Similarly, about the sample A6 (N: 0.0151%), its acceptance ratio of the straightness was as small as 63%.

Samples B1–B21 were samples wherein the ferrite grain size number was changed. About the sample B1, wherein its ferrite grain size number greatly exceeded the value defined in the present invention, its acceptance ratio of the straightness was as small as 53%. This would be because the fineness number was too small so that work hardening increased. In samples B2, B9–B11, B16, B17, B19 and B20, their ferrite grain size number exceeded the value defined in the present invention; therefore, their acceptance ratio of the straightness was below 90%.

On the other hand, in samples B3–B8, B12–B15, B18 and B21, their ferrite grain size number was No. 11 or less, and their acceptance ratio of the straightness was 90% or more. Particularly in the samples B3–B8 and B12–B15, their ferrite grain size number was No. 9.8 or less; therefore, their acceptance ratio of the straightness was about 100%.

Samples C1–C4 were samples wherein the Si content was changed. Si causes solid solution strengthening of ferrite. Therefore, in the samples C3 and C4 having a Si content over 0.05%, which was the upper limit preferred in the present invention, their MnS form was disadvantageous for machinability so that the surface roughness was rough. Thus, the machinability was lowered. Since the solid solution strengthening into ferrite was caused, the acceptance ratio of the straightness exhibited a somewhat low value in these samples (C3 and C4: 94% and 91%, respectively).

Samples D1-D5 were samples wherein the Mn content was changed. In the samples D2, D3 and D4, the Mn content was within the range preferred in the present invention. Therefore, their acceptance ratio of the straightness was 90% or more. However, in the sample D5, the Mn content was over the upper limit defined in the present invention, and MnS precipitated in a large amount. Therefore, many imperfections were generated in the surface of the steel product. In the sample D1, the Mn content was below the lower limit preferred in the present invention, and its acceptance ratio of the straightness was 99%. However, surface imperfections were generated by a liquid phase FeS at the time of the rolling.

Samples E1-E3 were samples wherein the P content was changed. In the sample E3, the P content was over the upper limit preferred in the present invention, and the surface roughness deteriorated by the shortening of the life span of the steel on the basis of a rise in the hardness thereof. Solution work hardening into ferrite was caused so that the acceptance ratio of the straightness was 92%, which was somewhat low.

Samples F1–F3 were samples wherein the Al content was changed. In the sample F3, the Al content was over the upper limited preferred in the present invention, and the form of MnS was disadvantageous for machinability by a drop in the concentration of oxygen. Thus, the surface roughness became rough. Work hardening was caused by precipitation of a large amount of AlN grains, so that the acceptance ratio of the straightness was 93%, which was somewhat low.

Samples G1–G7 were samples for examining an effect by the addition of Pb. In the samples G1–G5, the Pb content was not more than 0.4%, which was the upper limit preferred in the present invention, and their acceptance ratio of the straightness was 97% or more. However, in the sample G6, the N content (0.0129%) was over 0.01%, which was the upper limit defined in the present invention, and its acceptance ratio of the straightness was as small as 70%. In the sample G7, the fineness number (No. 12.3) of ferrite crystal was over No. 11, which was the upper limit defined in the present invention, and its acceptance ratio of the straightness was as small as 56%.

Samples H1-H6 were samples wherein the Bi content was changed. In the samples H1-H4, the Bi content was not more than 0.4%, which was the upper limit preferred in the present invention, and their acceptance ratio of the straightness was 99% or more. However, in the sample H5, the N content (0.0159%) was over 0.01%, which was the upper defined in the present invention, and its acceptance ratio of the straightness was 59%. In the sample H6, the fineness number (No. 12.4) of ferrite crystal was over No. 11, which was the upper limit defined in the present invention, and its acceptance ratio of the straightness was as small as 51%.

Samples J1–J18 were samples to which one or more free-cutting elements (Pb, Bi, Te, Se, Sn and In) were added. In the samples J1, J4, J5, J6, J9, J10, J11 and J14–J18, one or more of these elements were contained in an amount or amounts within the range(s) defined in the present invention, and their acceptance ratio of the straightness was 90% or more. However, in the samples J2 (N: 0.0177%), J7 (N: 0.0182%) and J12 (N: 0.0189%), wherein the N content was over 0.01%, which was the upper limit defined in the present invention, their acceptance ratios of the straightness were 55%, 52% and 58%, respectively, by an increase in work hardening ratio on the basis of solid solution of N. In the samples J3 (the ferrite grain size number: No. 12.4), J8 (the ferrite grain size number: No. 12.3) and J13 (the ferrite grain size number: No. 12.4), wherein the ferrite grain size number was over No. 11, which was the upper limit defined in the present invention, their acceptance ratios of the straightness were 52%, 50% and 54%, respectively, which were small values.

Samples K1-K5 were samples wherein one or more of elements such as Cr, Ni, Ti, Nb and V were contained. Their acceptance ratios of the straightness were 96% or more, which were high values.

The disclosure of the priority document, JP 11-326014, filed in Japan on Nov. 16, 1999, is incorporated by reference herein in its entirety.

What is claimed is:

1. A wire rod steel comprising:

| | |
|---|---|
| C: | 0.15 mass % or less, but not including 0 mass %; |
| Si: | 0.05 mass % or less, including 0 mass %; |
| Mn: | 0.3–2 mass %; |
| P: | 0.2 mass % or less, including 0 mass %; |
| S: | 0.08–0.5 mass %; |
| Al: | 0.05 mass % or less, including 0 mass %; |
| N: | 0.01 mass % or less, but not including 0 mass %; inevitable impurities; and Fe as the balance, wherein the wire rod steel has a ferrite grain size number of No. 11 or less according to ISO 643. |

2. The wire rod steel according to claim 1, further comprising one or more selected from the group consisting of:

| | |
|---|---|
| Pb: | 0.4 mass % or less, but not including 0 mass %; |
| Bi: | 0.4 mass % or less, but not including 0 mass %; |
| Te: | 0.2 mass % or less, but not including 0 mass %; |
| Se: | 0.4 mass % or less, but not including 0 mass %; and |
| In: | 0.4 mass % or less, but not including 0 mass %. |

3. The wire rod steel according to claim 1, wherein the N content is 0.008 mass % or less.

4. The wire rod steel according to claim 1, wherein the ferrite grain size number is No. 9.8 or less according to ISO 643.

5. The wire rod steel according to claim 1, wherein the Si content is 0.03 mass % or less.

6. The wire rod steel according to claim 1, comprising:

Al: 0.05–0.001 mass %.

7. A process for producing a wire rod steel, the process comprising hot working a wire rod steel, ending the hot working at 800° C. or higher, subsequently cooling the wire rod steel at a cooling rate of 3.0° C./second or less within the temperature range of 800–600° C., and producing the wire rod steel of claim 1.

* * * * *